United States Patent [19]

Hébert

[11] 4,096,676

[45] Jun. 27, 1978

[54] WALL MEMBER

[76] Inventor: Maurice Hébert, 6250, Bienville St., apt. A205, Brossard, Quebec, Canada

[21] Appl. No.: 816,678

[22] Filed: Jul. 18, 1977

[51] Int. Cl.[2] ..... E04B 5/48; E04B 1/00

[52] U.S. Cl. ..... 52/220; 52/105; 52/309.15; 52/496; 52/582; 52/542; 52/558; 52/593

[58] Field of Search ..... 52/282, 220, 233, 309.15, 52/309.14, 582, 595, 439, 105, 221, 173, 314, 403, 726, 404, 593, 511, 438, 515–517, 496

[56] References Cited

U.S. PATENT DOCUMENTS

| | | | |
|---|---|---|---|
| 1,570,720 | 1/1926 | Baker | 52/173 |
| 3,304,674 | 2/1967 | Ward | 52/233 |
| 3,552,079 | 1/1971 | Mortensen | 52/233 X |
| 3,562,403 | 2/1971 | Monahan et al. | 52/173 X |
| 3,564,795 | 2/1971 | Henton | 52/220 X |
| 3,788,020 | 1/1974 | Gregori | 52/439 X |
| 3,969,859 | 7/1976 | Hisey | 52/233 |
| 3,992,838 | 11/1976 | Vizziello | 52/233 |

FOREIGN PATENT DOCUMENTS

| | | | |
|---|---|---|---|
| 356,192 | 7/1919 | Germany | 52/233 |

*Primary Examiner*—Alfred C. Perham
*Assistant Examiner*—Robert C. Farber
*Attorney, Agent, or Firm*—Alan Swabey & Co.

[57] ABSTRACT

A "Wall Member" which comprises an elongated substantially rectangular extruded mono-shell defining an inner core, extruded in indefinite length, after which it is cut to the required dimension. The shell is made of low heat expandable material and contains an insulating material therein. The shell is formed with two vertical faces one of which having a permanent building exterior finish and the other having a permanent building interior finish. This interior vertical face is also provided within its main core, with an adjacent integral conduit therein for horizontal electrical leads. The shell is additionally formed with two horizontal upper and lower faces which are adapted for engagement over one another, such as by tongue and groove. These "Wall Members" are also adapted for connecting their ends which are provided with upper and lower hard surface fins to a structural vertical member such as a Post, window or door frames or another "Wall Member". The preferred material of the outer shell of the "Wall Members" and of the "Posts" is high density extruded wood fibrous pulp and resin mixture. The insulating material for the "Wall Members"only is preferably polyurethane foam which is sprayed and formed in simultaneously as the extrusion process producing the shell occurs; or styrofoam moulded to the inside shape of the shells and is thereafter inserted therein. The Post on the other hand is filled with a solid wooden core. This "Wall Member" and "Post" make it possible to produce low cost housing projects with the minimum of labor, because these prefinished "Wall Members", together with the "Posts" apart from doors and windows will constitute the whole of all the walls.

11 Claims, 14 Drawing Figures

Fig. 7
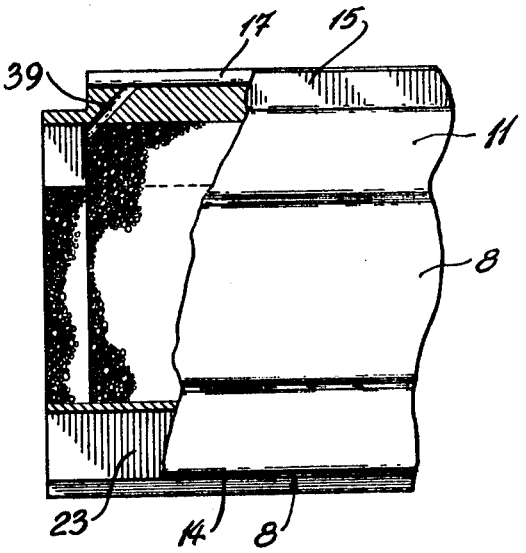
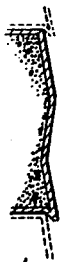
Fig. 8a
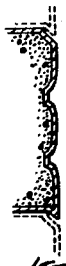
Fig. 8b
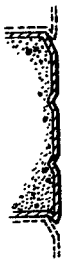
Fig. 8c
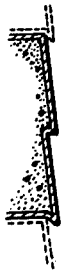
Fig. 8d
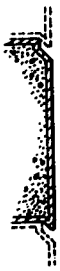
Fig. 8e
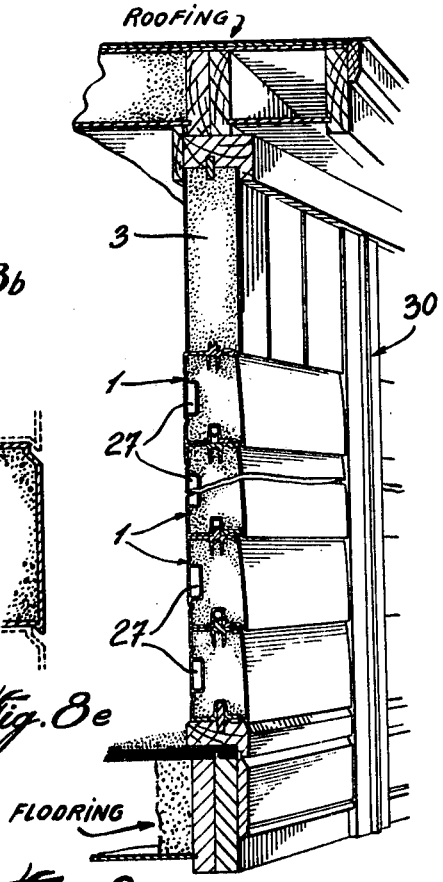
Fig. 9

WALL MEMBER

This invention relates to the field of building construction. More particularly, the invention relates to a "Wall Member" which will be used in the building construction and which is most suitable for low cost housing projects.

The field of construction in general and especially house construction is essential for a good economy. On the other hand, as population grows and the old buildings deteriorate, new residential buildings, preferably single house units, must necessarily be built in large quantities at reduced cost.

Standard construction has reached sky rocketing prices with the result that less and less people can now buy a house or a place to live in.

Therefore, there is a need for a system whereby it would be possible to build housing units at low cost while preserving a good quality of construction Prefabricated houses are known; however, since they are made with the same standard materials as the other construction units, their cost is not substantially reduced.

There is therefore a need to build a house at a price which is as low as possible, using cheap but efficient material, and as little labour as possible. However, to our knowledge, to this date, such construction technique is not available.

It is an object of the present invention to provide a building construction incorporating a "Wall Member" comprising an elongated substantially rectangular extruded shell defining an inner core, the shell being made of low heat expandable material, the shell being formed with two substantially vertical faces, one of the vertical faces having a permanent building exterior or interior finish, the other vertical face having a permanent building interior finish, the shell being additionally formed with two substantially horizontal upper and lower faces, each of the horizontal upper and lower faces having means for engaging a plurality of "Wall Members" over one another, the shell having an inner core filled with an insulating material, and means for connecting the ends of the "Wall Member" to a structural member.

The invention will now be illustrated by means of the following drawings, which illustrate a preferred embodiment, and in which:

FIG. 7 is a side view of one end of a "Wall Member" with a portion being cut away to better show the core, the fins and the engaging channel;

Figure 10:
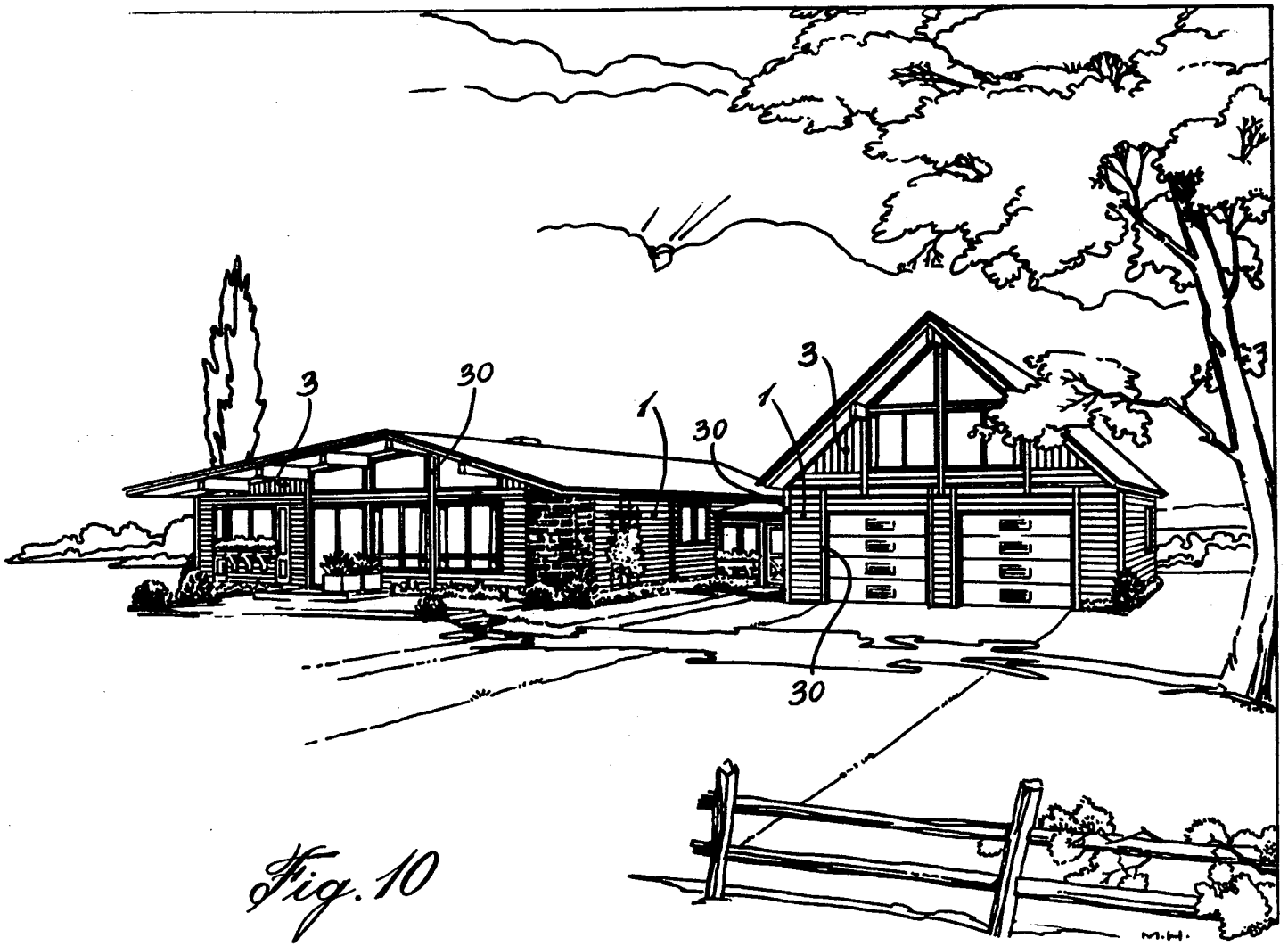

FIGS. 8*a*, 8*b*, 8*c*, 8*d*, and 8*e* show different embodiment shapings of exterior finish for an exterior horizontal Member;

FIG. 9 is a partial perspective view showing the mounting assembly of few Members over one another and onto a Post; and FIG. 10 is a simple perspective line drawing showing a typical residential assembly of a house, passageway and double space garage with studio, using throughout "Wall Members" and "Posts" illustrated in FIGS. 1 to 9.

Figure 1:
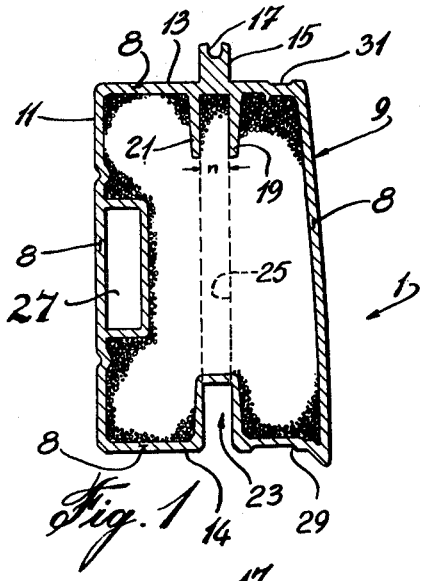
FIG. 1 is a cross-section of an exterior horizontal member with one inner electrical conduit.
Figure 2:
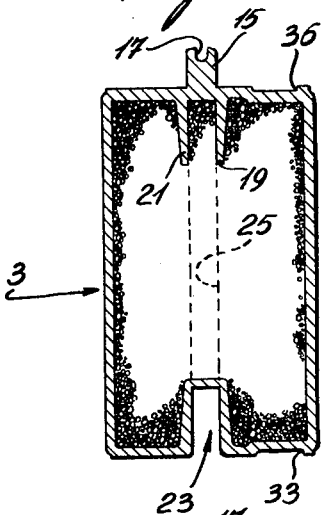
FIG. 2 is a cross-section of an exterior vertical even member.
Figure 3:
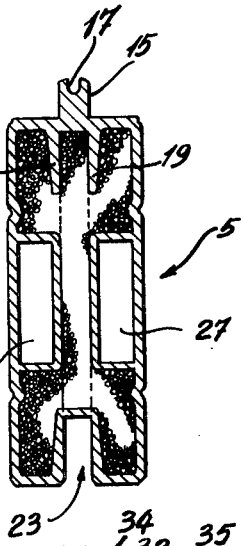
FIG. 3 is a cross-section of an interior horizontal member with two inner electrical conduits.
Figure 4:
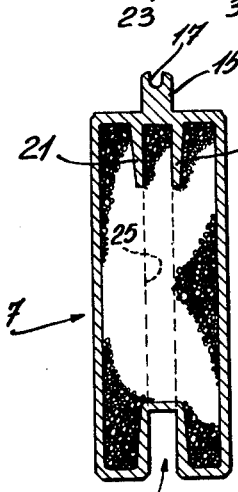
FIG. 4 is a cross-section of an interior vertical even member.

Referring to the drawings, more particularly FIGS. 1 to 4, it will be seen that in practice there will be four types of wall members. Wall member 1 shown in FIG. 1 is an exterior horizontal member which means that it will be mainly used for the construction of the outside walls of a house, and that such wall members 1 will be laid horizontally over one another. In FIG. 2, there is a plain exterior vertical member 3 which will be intended to be mounted vertically one against the other, preferably to define the upper part of an exterior wall mostly under the slope of a roof. In FIG. 3, there is shown an interior horizontal member 5 and in FIG. 4 there is illustrated an interior plain vertical member 7 of an interior wall, mostly under the slope of a roof.

We shall first of all consider wall member 1 with reference to FIG. 1. It will be seen to consist of a substantially rectangular shell 8 which, as shown in FIG. 9 is elongated, and can be made, preferably by extrusion, from any low heated expandable material, such as high density extruded wood fibrous pulp or, low thermal expansion and contraction plastic or the like of the type which are well known in the art.

Basically, when considering horizontal member 1, the latter will be seen to consist of two substantially vertical faces 9, 11 and two substantially horizontal faces 13, 14.

Vertical face 9 constitutes part of the exterior wall of a house or the like built with wall members 1 while vertical face 11 constitutes part of the interior wall of a housing unit. For this purpose, face 9 can only be formed into or applied with any kind of suitable shape or coating depending on the design and colour scheme selected. For example, the exterior face 9 could be shaped into some kind of clapboard imitation or any other desired shape, few as shown in FIGS. 8*a* to 8*e*. However, the appearance of the interior face 11 does not vary substantially in shape, and apart from a colour scheme applied thereto it may remain permanently as illustrated in FIG. 1.

If the material of the shell is a high density wood pulp, such as "MASONITE" (trademark), the faces 9, 11 could be provided with a suitable enamel coating of any desired colour. Of course, any other suitable finish can be provided on vertical faces 9, 11 and it is understood that this does not form part of the present invention.

Turning now to horizontal face 13, the latter is provided with a longitudinal tongue 15 which could be notched at 17 in view of utilizing less material in manufacturing the shell and also to facilitate the insertion of a screw or nail through the tongue 15 as will be described more in detail hereinafter.

Inside the shell 8, opposite the tongue 15, there is a pair of fins 19, 21, which project downwardly from the upper face 13 of the shell 8. The fins 19, 21 could vary in shape and design, as long as the space "*n*" which separates them corresponds to the thickness of the tongue 15.

Turning now to the lower face 14 of the shell 8, it will be realized that a groove 23 is formed therein. This groove should be dimensioned to receive a tongue 15 of an adjoining wall member 1. As shown, the tongue 15, the pair of fins 19, 21 and the groove 23 are all centrally aligned. This will permit the grooving of the ends of the wall member 3 between the fins 19, 21, the groove overlapping over the tongue 15 and into groove 23 thus producing a channel 25 as better shown in FIG. 6, which will permit engagement of the wall member 1 with any kind of structural member such as a Post or another "Wall Member" which is provided with a tongue. This will be discussed later on. The fins 19, 21 have been provided to create a rigid surface as part of the channel 25 to rigidly secure the wall members' ends with the tongue 34 of post 30.

As shown in FIG. 1, in forming the wall member 1 it is preferable to provide an electrical wiring conduit 27 in order to permit the wiring of a house thus assembled.

Referring to FIG. 2, the wall member 3 is generally similar to wall member 1 except that it has no electrical conduit 27 and the finish of the interior and the exterior faces 9, 11 are plain and could be used on a universal basis. Of course, here again, the finish of the vertical face 9 and vertical face 11 could vary a great deal having in mind that it is left to the choice of the designer of a house, having in mind, however, that the exterior vertical face 9 has a permanent weather proof finish.

Both wall members 1 and 3 are provided with caulking grooves. For example, wall member 1 has a caulking groove 29 formed on its lower horizontal face 14 and it has a caulking groove 31 formed on its upper horizontal face 13. The size and shape of these grooves can of course vary to a great width. However, in the present design, groove 31 is much more narrower than groove 29 because in case too much caulking is disposed in the groove 31 when mounting another wall member over upper face 13, any excess of caulking could be allowed to flow into caulking groove 29.

In connection with vertical wall member 3, it will be understood that there should normally not be any excess of caulking compound when applying it onto any of the grooves 33, 36 with the result that the two have been made of the same width.

With respect to interior wall members 5 and 7, the only difference is that they are both less thick than wall members 1 and 3, mainly because they do not require as much insulating material.

Also, in connection with wall member 5, two electrical conduits 27 have been provided because it might be necessary to lead electrical wiring on both sides of the partition formed by mounting wall members 5 one over the other.

For the same reason that wall member 3 has no electrical ducts, wall member 7 does not need to be provided with ducts 27.

Figure 5:
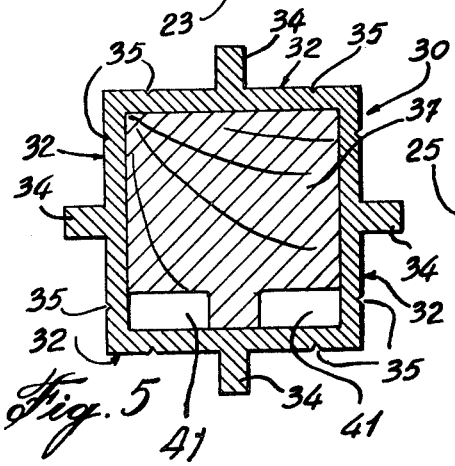
FIG. 5 is a cross-section through a Post adapted for engaging horizontal Members, said Post being formed with a similar extruded shell as the "Wall Members" but filled with a solid integral wooden core having on one side two vertical electrical lead conduits.

Although a wall member 1, 3, 5 or 7 can be connected to all kinds of structural members, it has been found preferable to use corner Post 30 as illustrated in FIG. 5. Post 30 consists of a shell 32 which could also be made of the same high density extruded wood fibrous pulp and resin mixture or, low thermal expansion and contraction plastic or the like as "Wall Members" 1, 3, 5, 7. Each of the four faces of the Post 30 is provided with a tongue 34, as shown. It will be realized that this will serve to connect wall members ends to the Post by engagement of the channel 25 with the tongue 34. Of course, one may elect to also use an adhesive between tongue 34 and the channel 25 in order to provide a really good connection between the wall member and the Post. Once the assembly is completed a caulking strip may be applied on the outside at the junction between the Post 30 and the exterior "Wall Members".

The four faces of the Post 30 are also provided with minute longitudinal grooves 35 which will serve as electrical lead for eventual hole center lines. The purpose of these center lines will be discussed later.

Of course, the Posts must be as rigid and as strong as possible because it constitutes the leading pillars to hold the walls and support the roof. For this purpose, a strong longitudinal member 37 which is preferably made of wood, is inserted in the interior of the shell 32 as shown in FIG. 5. The member 37 has a pair of cut-out portions 39, 41 to define electrical ducts which will enable the passing of electrical wires in the vertical direction through the Post. In order to be able to drill a hole through the shell 32 for reaching the ducts 39, 41, the electrical lead center lines 35 have been provided. Therefore, if it is intended to pass some electrical wiring through Post 30, it will merely be necessary to drill a hole through the shell by aligning the hole with one of the electrical lead center lines 35.

In practice, the post will have a square cross section. However, it is obvious that the Post can be designed with any suitable cross-section, such as rectangular, etc. For universal application, the Post should be symmetrical.

Figure 6:
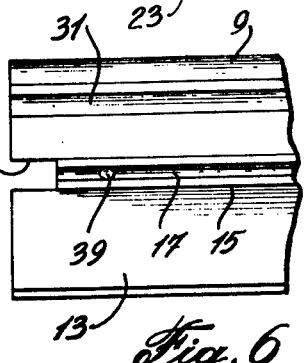
FIG. 6 is a top view of one end of a "Wall Member" showing one end ready for mounting.

Finally, the mounting of a wall member on a Post will be carried out by engaging the channel 25 on any one of the tongues 34 of the Post. In order to firmly anchor each end of the wall member on the Post, there is provided a longitudinal bore 39 which extends from the upper face 13 of the wall member 1 through the tongue 15 between the fins 19, 21 all as shown in FIGS. 6 and 7. This bore should be dimensioned to enable a nail or the like, such as a screw to be inserted through it and to penetrate into the Post 30 through tongue 34 in order to firmly anchor the wall member onto the Post.

As pointed out above, a vertical member 3 or 7 could be directly connected onto a horizontal member as particularly shown in FIG. 9. In this case, the channel 25 of the vertical member 3 is engaged over the tongue 15 of the "Wall Member" 1 or 5.

It will be realized that the "Wall Members" as shown in FIG. 9 will constitute the whole of any wall without anything else added and will replace an ordinary exterior wall of a standard house. In other words, with this invention it is possible to eliminate the following items in an ordinary home from the outside in:

*a* — outside painting
*b* — clapboard;
*c* — foreign lath (air space);
*d* — building paper;
*e* — sheathing;
*f* — studs and framing;
*g* — insulating wool;
*h* — inside sheathing;
*i* — building paper;
*j* — other foreign lath;
*k* — gyproc panel; and
*l* — finally the inside painting It is therefore possible to improve:

*m* — the appearance and styling;
*n* — the insulating properties (Polyurethane foam being about 2.5 times as effective as mineral wool ordinarily used)

*o* — the low cost of maintenance;

*p* — the versatility of styling and subdivisions; and

*q* — increasing by far, the simplicity of buying, building and using the house for the average people.

Of course, any combinations are possible within the spirit and scope of the present invention. The one shown in FIGS. 9 and 10 being only illustrative.

For example, with reference to FIG. 10, one could easily recognize wall member 1 and 3 and the Posts 30.

This system permits the construction of housing units with an infinite possibility of styling and dimension.

The shell and the Post can easily be prepared by extrusion as is well known in the art, whether fibrous pulp or plastic are used. The polyurethane foam will be sprayed within the shell simultaneously as the extrusion prosess proceeds; or styrofoam moulded to the inside shape of the shells and is thereafter inserted therein.

The lower parts of the Posts are anchored on corners or sides of the main floor.

I claim:

1. In a building construction, a wall member comprising:

an elongated substantially rectangular extruded shell defining an inner core, said shell being made of low heat expandable material;

said shell being formed with two substantially vertical faces;

one said vertical face having a permanent building exterior or interior finish;

the other vertical face having a permanent building interior finish, said shell being additionally formed with two substantially horizontal upper and lower faces wherein said upper face of said shell is provided with a longitudinal tongue, a pair of fins being formed inside said shell opposite said tongue, the space between said fins corresponding to the thickness of said tongue, a groove being formed in said lower face of said shell, said groove to receive a tongue of an adjoining wall member, said tongue, said pair of fins and said groove all being centrally aligned to enable grooving of the ends of said wall member between said fins and including said tongue, said grooving thus producing a channel to permit engagement of said wall member with a structural member;

said shell having its inner core filled with an insulating material.

2. In a building construction as defined in claim 1, wherein said insulating material is urethane foam which is sprayed within the shell simultaneously as the shell extrusion proceeds.

3. In a building construction as defined in claim 1, wherein said shell is made of a mixture of high density wood fibrous pulp and at least one resin.

4. In a building construction as defined in claim 1, wherein said shell is made of low thermal and contraction plastic material.

5. In a building construction as defined in claim 1, wherein said extruded shell is formed with at least one electrical wiring conduit.

6. In a building construction as defined in claim 1, wherein said wall member is adapted for vertical mounting and said horizontal faces become vertical edges of said wall member.

7. In a building construction as defined in claim 3, wherein said shell has a permanent prefinished external face.

8. In a building construction as defined in claim 1, wherein said structural member comprises a post provided with longitudinal tongues said tongues being engageable in said channel formed at the end of said wall member.

9. In a building construction as defined in claim 1, wherein said structural member consists of another wall member at right angle with respect to said first wall member, the channel in said another wall member engaging the tongue of said first wall member.

10. In a building construction as defined in claim 8, wherein said post consists of a shell with substantially square cross-section, said shell being filled with a rigid substance, longitudinal voids being provided between said shell and said rigid substance to define ducts.

11. In a building construction as defined in claim 1, which comprises a longitudinal bore angularly extending from the upper face of said wall member through said tongue, and between said fins, said bore so arranged to enable a nail, adhesive or the like to be inserted through said bore and to penetrate into said structural member to hold the two together.

* * * * *